US006082139A

United States Patent [19]

Davidziak

[11] Patent Number: 6,082,139

[45] Date of Patent: Jul. 4, 2000

[54] JEWELRY ARTICLE WITH UNIVERSALLY MOVEABLE APPENDAGES

[76] Inventor: Andre Davidziak, 584B Raritan Rd., Roselle, N.J. 07203

[21] Appl. No.: 09/224,570

[22] Filed: Dec. 30, 1998

[51] Int. Cl.[7] ..... A44C 25/00

[52] U.S. Cl. ..... 63/23; 446/376; 446/383; 446/384

[58] Field of Search ..... 63/23; 446/376, 446/378, 383, 384

[56] References Cited

U.S. PATENT DOCUMENTS

| | | | |
|---|---|---|---|
| 553,643 | 1/1896 | Fausel | 446/376 |
| 942,524 | 12/1909 | Sneyd . | |
| 2,001,334 | 5/1935 | Stein | 446/384 |
| 2,118,682 | 5/1938 | Nagel | 446/384 |
| 2,888,776 | 6/1959 | Sauer | 446/251 |
| 3,526,103 | 9/1970 | Lieber . | |
| 4,030,240 | 6/1977 | Port | 446/321 |
| 4,245,486 | 1/1981 | Matsumoto et al. . | |
| 4,415,291 | 11/1983 | Smith | 403/36 |
| 4,512,748 | 4/1985 | Matsumoto et al. . | |
| 4,581,904 | 4/1986 | Lehmann et al. . | |
| 4,657,519 | 4/1987 | Kobayashi | 446/376 |
| 4,680,019 | 7/1987 | Baerenwald et al. | 446/378 |
| 4,967,574 | 11/1990 | Bielka . | |

FOREIGN PATENT DOCUMENTS

| | | | |
|---|---|---|---|
| 1312723 | 11/1962 | France | 446/376 |
| 61965 | 4/1892 | Germany | 446/376 |
| 9562 | 5/1892 | United Kingdom | 446/376 |
| 157548 | 1/1921 | United Kingdom | 446/376 |

*Primary Examiner*—Lynne H. Browne
*Assistant Examiner*—Andrea Chop
*Attorney, Agent, or Firm*—Akin, Gump, Strauss, Hauer & Feld, LLP

[57] ABSTRACT

A jewelry article, such as a charm or pendant, includes a hollow body having plural generally spherical bearing recesses for receiving bearing parts of plural appendages which are secured to the body by respective retaining pins having truncated spherical head portions and shank portions which project from the bearing part to the interior of the body. The pin shank portions are soldered to the body from within the interior cavity to provide rotatable hidden joint connections between the body and the appendages, respectively. Each appendage has an additional elongated part which is secured to the bearing part after the bearing part is secured to the body. The body is cast as a two part hollow structure, one of the body parts having the plural recesses and a hemispherical boss for supporting the bearing parts of the appendages and for supporting a further appendage by a retaining pin extending from within the one body part through the further appendage. The interior cavity of the body is closed by securing a second body part to the first mentioned body part.

7 Claims, 4 Drawing Sheets

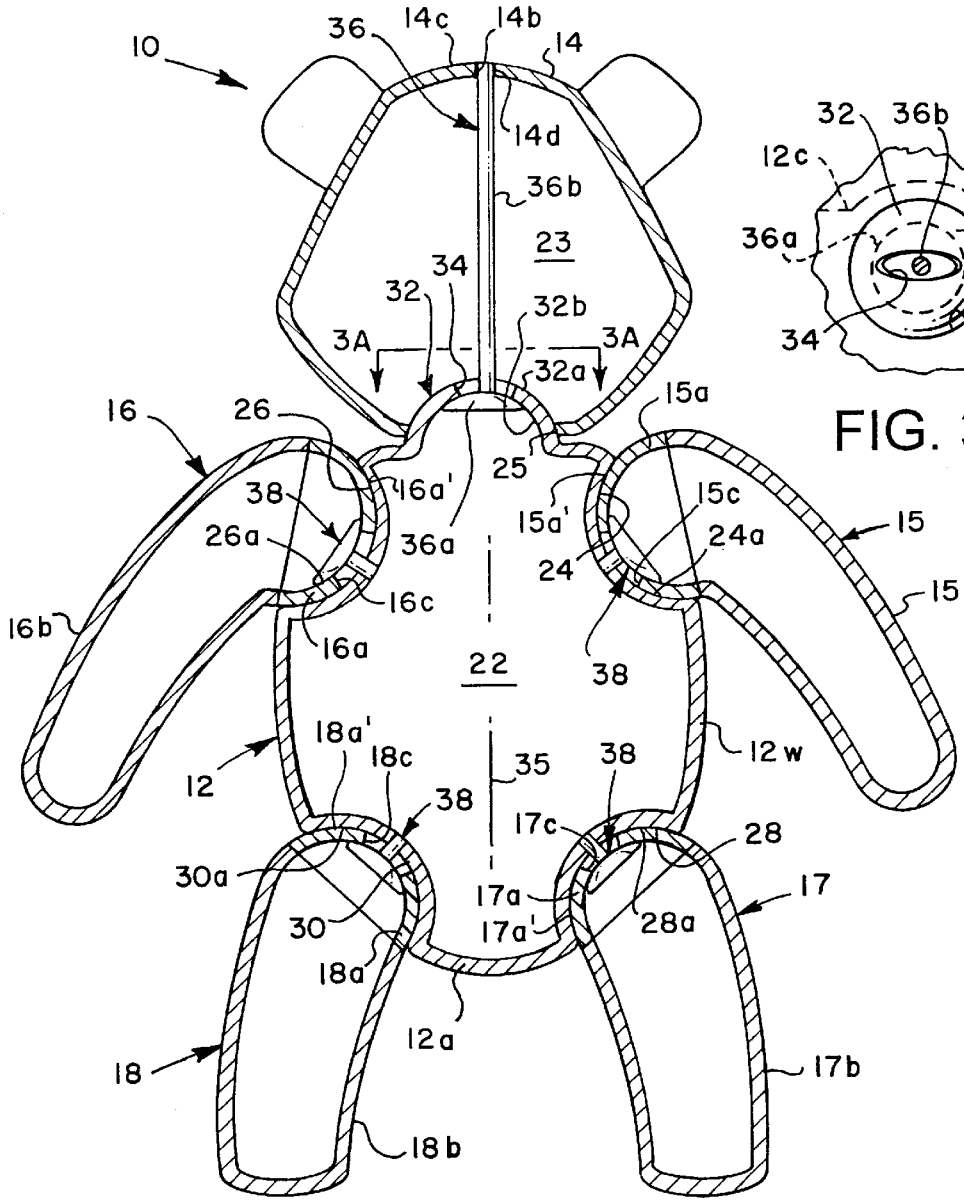
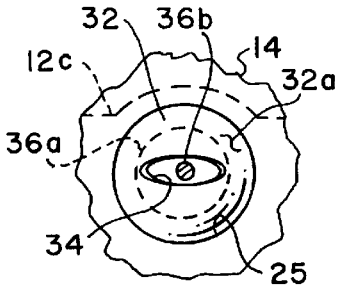
FIG. 3A
FIG. 3

JEWELRY ARTICLE WITH UNIVERSALLY MOVEABLE APPENDAGES

FIELD OF THE INVENTION

The present invention pertains to a jewelry article, such as a charm or pendant, having a body and universally moveable appendages connected to the body by pin-type joint connections.

BACKGROUND

Jewelry articles, such as pendants and charms having moveable appendages, are known, and such articles, having the form of various animals with movable head, arm and leg appendages are particularly popular. Such articles are relatively small, are typically cast of precious or semiprecious metals and have a main body or torso cast as a hollow member and wherein the appendages such as the head, arms and legs, may also be hollow or solid cast parts.

The attraction or appeal of animal charms or pendants and similar jewelry articles is enhanced if the article appendages have some degree of universal or omnidirectional movement relative to the article body. However, the fabrication and assembly of such articles can be rather difficult due to the physical size of the articles and the requirement for proper retention of the moveable appendages with respect to the main body or torso of the article. For example, the overall height or length of a charm or pendant in the form of an animal may typically be less than about 1.0 inches and the length of the appendages may be no more than 0.25 inches.

Efforts have been attempted in the prior art to develop suitable connections between the main body part of a charm or pendant and the moveable appendages therefor. However, the complexity of the assembly process in accordance with certain prior art designs, including designs which require multiple solder joints and connections which place undue stress on the joint members has created a need for an improved joint connection between the appendages and the main body member of animal charms or pendants, as well as similar jewelry articles, which have interconnected parts which are moveable relative to each other. One such improvement is disclosed and claimed in my co-pending U.S. patent application Ser. No. 09/149,936, filed Sep. 9, 1998 and assigned to the assignee of the present invention. However, there has been a desire and need to provide an animal charm or pendant or similar jewelry article having, as a novelty feature, one or more appendages connected to a main body or torso and wherein the appendages are somewhat universally or omnidirectionally moveable relative to the torso.

Accordingly, the present invention overcomes the disadvantages of certain prior art joint connections between parts of jewelry articles, such as animal form pendants and charms, while providing at least limited universal or omnidirectional movement between the parts forming the joint and while also meeting substantially all of the desiderata of a reliable and easily fabricated joint connection for such items.

SUMMARY OF THE INVENTION

The present invention provides an improved jewelry article, such as an animal form charm or pendant, which article includes a joint connection between parts thereof and wherein the parts are moveable relative to each other somewhat omnidirectionally. In particular, the invention provides an improved joint connection between a body or torso and moveable appendages comprising a head, arms and/or legs of an animal form pendant or charm.

In accordance with one aspect of the invention, a jewelry article is provided with a main body and one or more movable appendages connected thereto. The main body is formed as a two-part hollow cast member and is provided with one or more convex or concave, somewhat spherical bearing surfaces for supporting moveable appendages, such as a head, arms and legs, and wherein the appendages are each connected to the main body by a retaining pin having a head portion which is retained inside a hollow space within each appendage or within a hollow space formed by the body, in the case of the connection between the body and a head member. The pin retaining head portion preferably includes a spherical bearing surface formed thereon.

Preferably, the appendages are also hollow members which are cast in two parts to provide for attaching appendage connecting the pin to the article body and wherein after such attachment is accomplished the two parts of each appendage are then secured to each other to form an integral appendage. The retaining pins are preferably joined to the body by a soldering operation and the two parts of the appendages are preferably secured to each other by soldering.

In accordance with another aspect of the invention an animal charm or pendant type jewelry article is provided with a hollow main body which is formed in two parts and which includes integral concave and convex bearing sockets or bosses for receiving, in supportive relationship, body appendages such as arms and legs and a head member, respectively. The appendages are connected to the main body or torso member by a pin type connection and wherein the bearing sockets or bosses support the appendages with respect to the body in a way such as to reduce stresses acting thereon which could be injurious to the joint and the connecting or retaining pin.

In accordance with still another aspect of the invention an animal form pendant, charm or similar jewelry article is provided which has parts which are interconnected by a unique universal type joint and which allow easy movement or rotation of the parts relative to each other, but also provide a joint connection which is not loosely fitted.

The present invention still further provides an improved jewelry article with interconnected parts which are moveable relative to each other and wherein the article is formed by an improved method of assembly. Those skilled in the art will appreciate the above mentioned advantages and superior features of the invention together with other important aspects thereof upon reading the detailed description which follows in conjunction with the drawing.

BRIEF DESCRIPTION OF THE DRAWINGS

FIG. 3 central section view taken generally along the line 3—3 of FIG. 2;

FIG. 3A is a detail view taken from line 3A—3A of FIG. 3;

DETAILED DESCRIPTION OF PREFERRED EMBODIMENTS

Figure 1:
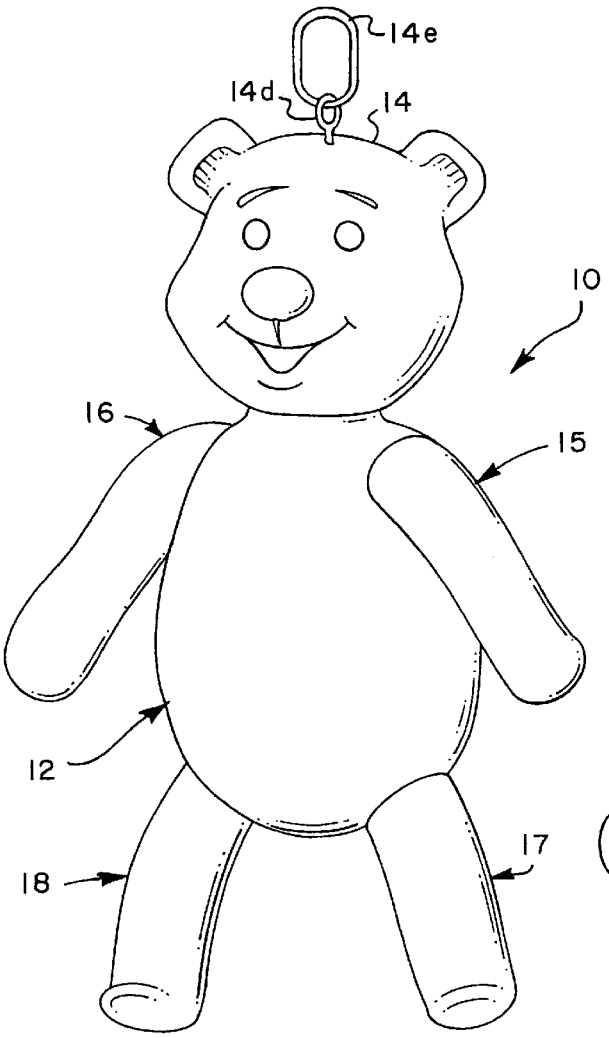
FIG. 1 is a perspective view of a jewelry article comprising an animal form pendant or charm with moveable appendages in accordance with the present invention.

In the description which follows, like parts are marked throughout the specification and drawing with the same reference numerals, respectively. The drawing figures are not necessarily to scale and certain features of the invention may be exaggerated in scale in the interest of clarity and conciseness.

Figure 2:
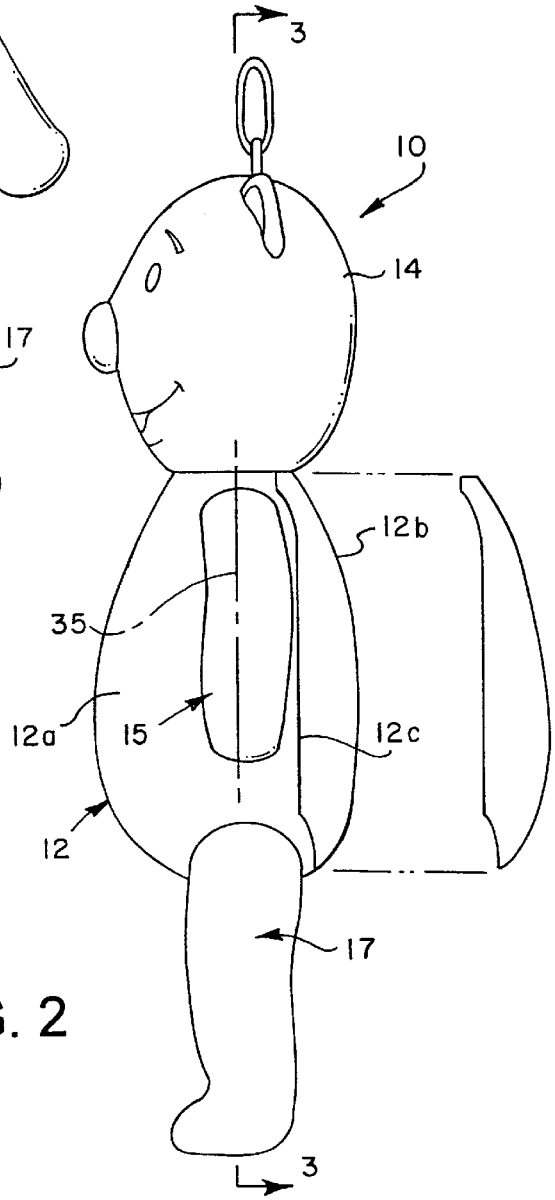
FIG. 2 is a side elevation of the article shown in FIG. 1 and showing a removable part of the body or torso of the article.

Referring to FIGS. 1 and 2, there is illustrated a jewelry article or the like, generally designated by the numeral 10, having parts which are interconnected in such a way that they are essentially universally or omnidirectionally moveable relative to each other. A preferred embodiment of the jewelry article 10 comprises a pendant or charm having the form of an animal, such as a bear, as illustrated. The article 10 includes a hollow body 12; preferably cast of a precious or semi-precious metal, to which are connected a head 14, respective arms or front legs 15 and 16 and rear or lower legs 17 and 18.

Figure 7:
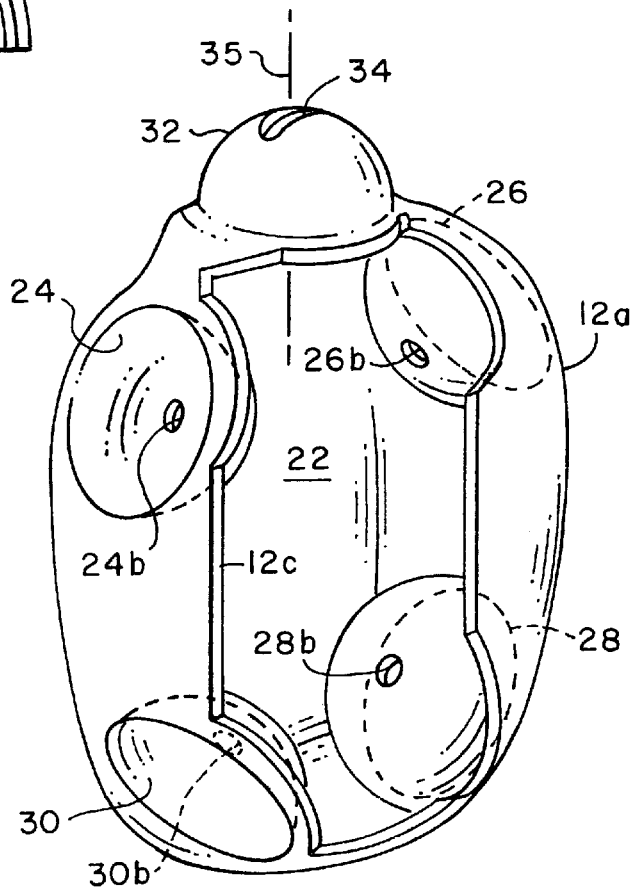
FIG. 7 is a perspective view of the main body part of the article of the present invention.

As shown in FIG. 2, the body 12 is preferably formed in two separable parts 12*a* and 12*b* which are joined along a continuous parting line 12*c*, see FIG. 7 also. The body parts 12*a* and 12*b* are suitably secured to each other by an adhesive or by conventional soldering or welding techniques known to those skilled in the art of jewelry fabrication. The body parts 12*a* and 12*b* are also typically formed by conventional investment casting methods, for example. Moreover, the head 14 and the legs 15 through 18 may also be fabricated using conventional investment casting methods. Accordingly, the article 10 is preferably formed of plural, substantially hollow members.

As indicated in FIG. 2, the parting line 12*c* is preferably located somewhat displaced from a central longitudinal axis of the body 12 for a purpose to be described in further detail herein. The primary plane of the parting line 12*c* is also oriented to be generally parallel to the axes of respective retaining pins for the joints which provide for connecting the head 14 and the legs 15 through 18 to the body 12 for movement relative to the body, as will be further understood from description hereinbelow.

To facilitate assembly of the article 10, the above-described arrangement of the parting line 12*c* between the body parts 12*a* and 12*b*, which separates the body 12 into a front part 12*a* and a rear part 12*b*, as indicated, is preferable to splitting the body 12 in such a way as to provide a left half and right half configuration. Alternatively, the body 12 could be separated into upper and lower parts. This characterization of front, rear, upper and lower is used in the context of an erect body 12, as illustrated in FIGS. 1 through 3.

Referring now primarily to FIG. 3, and also FIG. 7, the body 12 is formed with an interior cavity 22 and upper opposed so-called shoulder recesses 24 and 26 defined by the body shell wall 12*w* and being of somewhat spherical shape as shown in FIGS. 3 and 7. The body part 12*a* is also formed with lower opposed shoulder or hip recesses 28 and 30 which are also, preferably, of spherical shape. The recesses 24, 26, 28 and 30 are defined by spherical concave bearing surfaces 24*a*, 26*a*, 28*a* and 30*a*, respectively.

Still further, viewing FIG. 3, the body part 12*a* includes a generally spherical shaped boss 32 formed thereon between the shoulder recesses 24 and 26 and forming a support for the head 14. In this regard, boss 32 includes a generally spherical convex bearing surface 32*a*. The head 14, as shown, comprises a hollow cast part having an interior space 23 and a bearing part formed by a generally cylindrical bore 25 formed in the base thereof and adapted to be supported on the spherical bearing surface 32*a*.

Referring further to FIG. 3 and FIG. 3A, the boss 32 is advantageously provided with a somewhat elliptical shaped opening 34 formed therein substantially centered on a radial line or axis of the boss and coaxial with a substantially central longitudinal axis 35 of the body 12, and the head 14, as indicated in FIG. 3. The head 14 is retained on the body 12 by an elongated retaining pin 36 having a truncated spherical head portion 36*a* and an elongated cylindrical shank 36*b*. The head portion 36*a* is adapted to conform in shape to an inner concave spherical surface 32*b* of the boss 32, which surface faces the interior cavity or space 22.

The shank 36*b* projects through the elliptical opening 34 and through a suitable opening or bore 14*b* on the top 14*c* of head 14 and wherein the pin shank 36*b* is suitably soldered to the head 14 at the bore 14*b* from the exterior of the head by a solder layer 14*d*, for example. The pin 36 may also be secured to the head 14 by a suitable adhesive or, by peening over the end of the pin shank 36*b* to "rivet" the pin shank to the head 14. Thanks to the provision of the somewhat elliptical opening 34 and by providing the pin shank 36*b* to be smaller in diameter than the diameter of the minor axis of the opening 34, the head 14 may be moved substantially omnidirectionally with respect to the body 12 on its supporting boss 32. In this way, a unique attachment of the head 14 to the body 12 is obtained.

The configuration of the elliptical opening 34 may be such that the major axis of the opening extends in a direction perpendicular to the direction which is parallel to the plane of parting line 12*c*, indicated in FIG. 3A. Alternatively, the ovality of the opening may be varied such that the major and minor axes of the opening are not significantly different. However, the arrangement of the opening 34 such that substantial side-to-side head motion may be obtained without substantial fore and aft or up and down head motion may be preferable. Still further, the retaining pin 36 may be attached to the head 14 while forcibly engaging the head 14 with the bearing surface 32*a* so that a snug fit of the head 14 with the boss 32 may be obtained also. As will be appreciated by those skilled in the art, the pin 36 is connected to the body 12 and the head 14 by inserting the pin shank 36*b* through the opening 34 from the cavity or space 22 while the body part 12*b* is removed from the body part 12*a*. As shown in FIGS. 1 and 2, a suitable hanger eye 14*d* and hanger link 14*e* may be attached to head 14 in a suitable manner.

Referring further to FIG. 3, each of the appendages 15, 16, 17 and 18 is connected to the body part 12*a* in a manner similar in some respects to the manner in which the head 14 is connected to the body part. Each of the appendages 15, 16, 17 and 18 is preferably fabricated as a two part appendage having a generally hollow spherical bearing part 15*a*, for example and an elongated hollow-appendage part 15*b*. Appendages 15, 16, 17 and 18 each have respective, generally spherical hollow bearing parts 15*a*, 16*a*, 17*a* and 18*a*, having respective concave and convex bearing surfaces formed thereon, as shown, and which are adapted to be connected to elongated appendage parts 15*b*, 16*b*, 17*b* and 18*b*, respectively. The spherical bearing parts 15*a*, 16*a*, 17*a* and 18*a* are dimensioned to be snug, but rotatable fits within the respective recesses 24, 26, 28 and 30 include respective convex spherical bearing surfaces 15*a*', 16*a*', 17*a*' and 18*a*' being engageable with the cooperating bearing surfaces 24*a*, 26*a*, 28*a* and 30*a*, respectively. As shown also in FIG. 7, the respective body recesses are provided with substantially cylindrical pin receiving openings or bores 24*b*, 26*b*, 28*b* and 30*b*, substantially at the apexes of the recesses and opening into the cavity or space 22.

Figure 4:
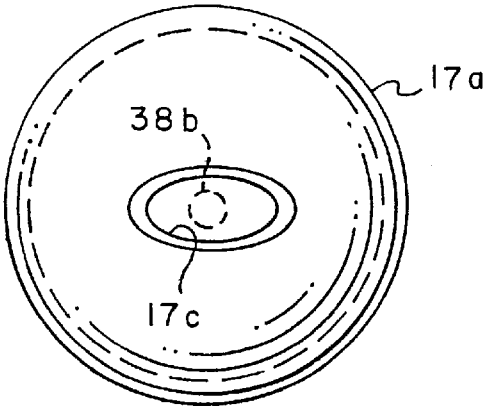
FIG. 4 is a detail plan view of the bearing part of one of the appendages.
Figure 6:
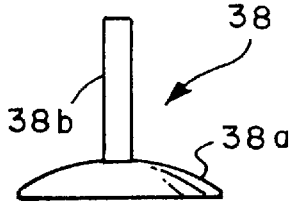
FIG. 6 is a side elevation of a connecting and retaining pin for forming the joint connection between an appendage and the body of the article of the present invention.
Figure 5:
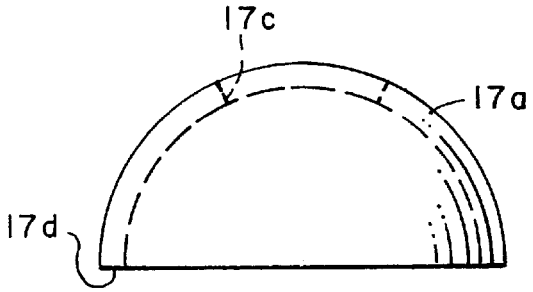
FIG. 5 is a side elevation of the part shown in FIG. 4.
Figure 8:
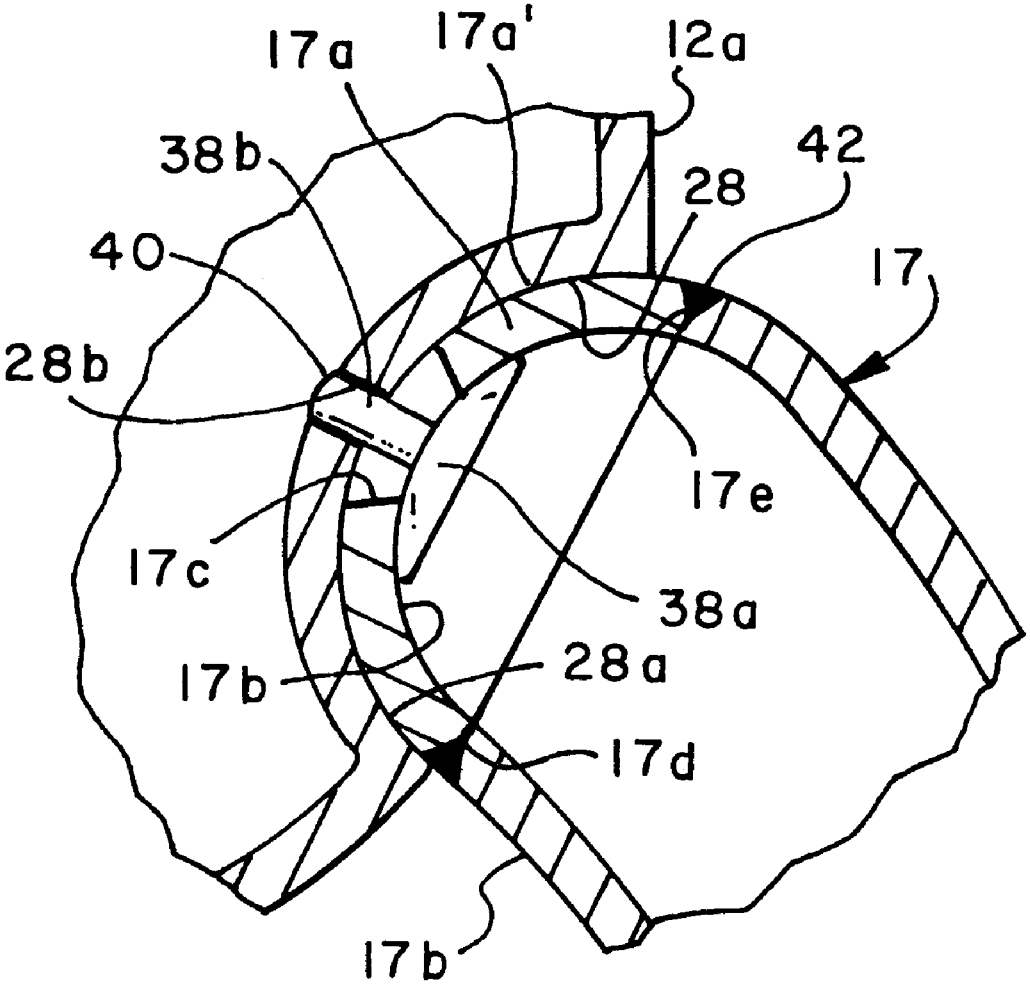
FIG. 8 is a section view on a larger scale showing details of an appendage joint connection in accordance with the invention.

Referring now primarily to FIGS. 4 through 6 and 8, there is illustrated, by way of example, how a joint between the appendage 17 and the body 12 is provided in accordance with the invention. As shown in FIGS. 4 and 5, the appendage bearing part 17*a*, for example, is a substantially spherical hollow member having an elliptical opening 17*c* formed at the apex of the bearing part, as indicated. The opening 17*c* is opposite a peripheral rim portion 17*d* of bearing part 17*a* which provides for attaching bearing part -17*a* to the elongated appendage part 17*b* along a cooperating rim portion 17*e* of appendage 17*b*, indicated in FIG. 8. As shown in FIG. 8, the appendage bearing part 17*a* is connected to the body 12 by a retaining pin 38 having a truncated spherical head 38*a* and an integral shank portion 38*b*, which is adapted to project through the opening 17*c* and the opening or bore 28*b*, as indicated in FIG. 8. The shank portion 38*b* is secured to the body 12*a* at the bearing recess pin receiving bore 28*b* by solder 40 or a suitable adhesive, as indicated in FIG. 8. Accordingly, the appendage bearing part 17*a* is secured to the body part 12*a* in substantially the same manner that the head 14 is secured to the body part except that the spherical head part 38*a* is disposed to engage the an inner concave bearing surface 17*b* of bearing part 17*a* and pin shank 38*b* projects into the opening 28*b* from the opposite direction to that of the shank portion of the pin 36 with respect to the body part 12*a*.

Appendage bearing parts 15*a*, 16*a*, and 18*a* may each also be secured to the body part 12*a* by a retaining pin 38, as shown in FIG. 3, projecting through elliptical openings 15*c*, 16*c*, and 18*c*, respectively, substantially like the opening 17*c*. Each of the retaining pins 38 is secured to the body part 12*a* in the manner just described for the retaining pin 38 which secures the bearing part 17*a* to the body part 12*a*.

Accordingly, referring again to FIGS. 3 and 8, a preferred method of assembling the bearing parts 15*a*, 16*a*, 17*a* and 18*a* to the body part 12*a* includes placing these parts in their respective recesses 24, 26, 28 and 30 and inserting the respective retaining pins 38 through the somewhat elliptical openings in each bearing part and then through the corresponding opening or bore in the respective body part recesses followed by soldering the shank portions 38*b* of the pins 38 to the body part 12*a* from within the cavity 22. Moreover, by providing the somewhat elliptical shaped openings, such as the opening 17*c*, having a minor axis dimension greater than the diameter of the pin shank 38*b*, see FIG. 4 also, limited universal or omnidirectional movement of the bearing parts of the respective appendages may be obtained once these parts are retained in assembly with the body part 12*a*. Alternatively, those skilled in the art will appreciate that the retaining pins 38 could be secured to each bearing part, project through an elongated elliptical bore in each appendage recess wall of body part 12*a* and be secured by suitable means, such as a cap or washer secured to the distal end of each pin shank, respectively.

After attaching each of the aforementioned appendage bearing parts to the body part 12*a*, the elongated appendage parts 15*b*, 16*b*, 17*b* and 18*b* are, respectively, attached to their respective bearing parts by, for example, soldering the parts together with a circumferential solder layer 42, for example, see FIG. 8. This soldering operation is carried out to secure the parts 17*a* and 17*b* to each other, for example, at their mating surfaces 17*d* and 17*e* therearound. Any excess solder extending above the exterior surface of bearing part 17*a* may then be suitably removed so that there is no interference between the appendage 17 and the body recess 28, for example, whereby substantially universal or omnidirectional movement of the appendage with respect to the body 12 may occur.

Once all of the appendages 14, 15, 16, 17 and 18 have been connected to the body part 12*a*, the body part 12*b* may be suitably secured to the body part 12*a* by solder or an adhesive and additional finishing operations may be carried out on the respective parts of the charm or pendant 10, as needed or desired. Thanks to the configuration of the appendages and body parts and the retaining pins 36 and 38 for the charm or pendant 10, the appendages are universally moveable with respect to the body or torso 12 which adds to the aesthetic appeal of the article. A suitable coating or plating may be applied to the respective parts of the jewelry article 10 to conceal the joints between the respective parts of each appendage and between the respective body parts.

The fabrication of the jewelry article 10, including the steps described herein, may be carried out using otherwise conventional techniques for cast metal and other types of jewelry articles which have interconnected parts that are moveable relative to each other. Moreover, while the invention herein has been illustrated and described for the fabrication of a pendant or charm in the form of an animal. Jewelry articles of other forms or shapes may be fabricated using the features of the invention and various modifications and constructions may be implemented without departing from the scope and spirit of the appended claims.

What is claimed is:

1. A jewelry article comprising:

a hollow body forming an exterior wall and an interior cavity and including a neck portion defined by a generally spherical hollow boss formed at an upper wall portion of said body and communicating with said interior cavity, and a pin receiving opening in said hollow boss;

a head appendage attached to said neck portion for limited omnidirectional movement with respect to said neck portion without disconnection therefrom, said head appendage including a lower wall portion with an opening formed therein, said hollow boss of said body being disposed in said opening in said head appendage;

a retaining pin including a generally spherical head portion and a shank having a distal end, said shank being inserted through said pin receiving opening in said hollow boss and said opening of said head appendage with said spherical head portion resting against an interior surface of said hollow boss, said distal end of said shank being directly secured to said head appendage, said pin receiving opening in said hollow boss being larger than said shank to provide for said limited omnidirectional movement of said head appendage with respect to said neck portion without disconnection therefrom.

2. The article set forth in claim 1 including:

another appendage having a bearing part engaged with a generally spherical recess formed on said body and another retaining pin engaged with said recess and having a head part and a shank, said head part of said another retaining pin engaged with an inner surface of said bearing part and said shank of said another retaining pin extending through an elongated opening in said bearing part, a distal end of said shank of said another retaining pin being secured in an opening formed in said recess.

3. The article set forth in claim 2 wherein:

said body includes a bearing surface formed in said recess and said bearing part of said another appendage is engageable with said bearing surface.

4. The article set forth in claim 2 wherein:

said opening in said bearing part is generally elliptical.

5. The article set forth in claim 2 wherein:

said elongated appendage part is secured to said bearing part by soldering said elongated appendage part to said bearing part.

6. The article set forth in claim 2 wherein:

said body includes a plurality of recesses forming bearing surfaces for corresponding bearing parts of plural appendages to be secured to said body, each by one of said retaining pins, respectively.

7. The article set forth in claim 1 a wherein:

said opening in said boss is substantially elliptical.

* * * * *